US006997351B2

(12) United States Patent
Cho

(10) Patent No.: US 6,997,351 B2
(45) Date of Patent: Feb. 14, 2006

(54) BOTTLE CAP

(76) Inventor: Young Kook Cho, P.O. Box 2172, Huntington Park, CA (US) 90802

( * ) Notice: Subject to any disclaimer, the term of this patent is extended or adjusted under 35 U.S.C. 154(b) by 0 days.

(21) Appl. No.: 11/085,338

(22) Filed: Mar. 21, 2005

(65) Prior Publication Data

US 2005/0218104 A1 Oct. 6, 2005

(51) Int. Cl.
*B67D 5/00* (2006.01)

(52) U.S. Cl. ..... 222/82; 222/83.5; 222/136; 206/222

(58) Field of Classification Search ..... 222/82, 222/83.5, 136, 145.1, 383.1; 206/222
See application file for complete search history.

(56) References Cited

U.S. PATENT DOCUMENTS 3,024,947 A * 3/1962 Jeynes, Jr. ..... 222/83.5
3,548,562 A * 12/1970 Schwartzmann ..... 206/222
3,655,096 A * 4/1972 Easter ..... 206/222
3,966,089 A * 6/1976 Klingaman ..... 222/88
6,290,100 B1 * 9/2001 Yacko et al. ..... 222/383.1

* cited by examiner

*Primary Examiner*—Philippe Derakshani
(74) *Attorney, Agent, or Firm*—Jerry H. Noh

(57) ABSTRACT

Disclosed herein is bottle cap which has a spraying unit or a nipple cap, with a space defined therein to contain an additive, such as a detergent, brightening agent or powdered milk. The bottle cap includes: an immobile unit having a guide part tightened to the mouth of a bottle body, and a chamber part inserted into the mouth, with a breaking tip and a through hole provided in the bottom of the chamber part, and a pipe part provided along the central axis of the chamber part; a storage container having a cylinder part inserted into the chamber part, a breakable film covering the open lower end of the cylinder part; a hole extending through the storage container and receiving the pipe part therein; and an externally threaded part extending upward from the upper end of the cylinder part and engaging with the guide part; a spraying unit having a cap part tightened to the externally threaded part, and a conduit pipe inserted into the pipe part. A spacing band is assembled around the externally threaded part at a position between the guide part and the cap part, thus spacing the spraying unit apart from the immobile unit by a predetermined interval. The spraying unit may be replaced with a nipple cap.

7 Claims, 4 Drawing Sheets

BOTTLE CAP

BACKGROUND OF THE INVENTION

1. Field of the Invention

The present invention relates generally to bottle caps and, more particularly, to a bottle cap which contains an additive therein and allows a user to mix the additive with a liquid, contained in a bottle body, at a desired real time.

2. Description of the Related Art

Generally, a conventional bottle containing a detergent or a car brightening agent therein is typically provided with a spraying unit in place of a cap. The conventional bottle contains a previously mixed solution including such a detergent or brightening agent.

However, most of the solution contained in the conventional bottle for detergents or car brightening agents is water, but the amount of detergent or car brightening agent having a practical function of washing or brightening is much less than the amount of water in the solvent. Thus, users are forced to purchase conventional bottles containing the solutions previously prepared by mixing the detergent or the brightening agent with water, although it is very economically advantageous for the users to purchase only a detergent or a brightening agent and use the detergent or the brightening agent after mixing them with water in an existing bottle having a spraying unit.

SUMMARY OF THE INVENTION

Accordingly, the present invention has been made keeping in mind the above problems occurring in the prior art, and an object of the present invention is to provide a bottle cap which has a spraying unit or a nipple cap, with a space defined therein to contain an additive, such as a detergent, brightening agent or powdered milk, and which is thus distributed in markets separately from bottles, thereby reducing the transportation costs of products, allowing users to save money, and saving natural resources.

In order to accomplish the above object, the present invention provides a bottle cap comprising an immobile unit having a guide part and chamber part. The guide part attaches to the mouth of a bottle body through a screw-type engagement, and the chamber part inserts into the mouth of the bottle body. A breaking tip protrudes upward from the bottom of the chamber part, and at least one hole is formed through the bottom of the chamber part. Furthermore, a pipe part extends upward from along the central axis of the chamber part. The bottle cap also has a storage container having a cylinder part and an externally threaded part extending from the upper end of the cylinder part. The cylinder part inserts into the chamber part, and the cylinder part has an open lower end which is covered and closed by a breakable film. A hole extends through the storage container and is formed to receive the pipe part therein. The externally threaded part engages with the guide part of the immobile unit through a screw-type engagement. The bottle cap furthermore has a spraying unit comprising a cap part tightened to the externally threaded part through a screw-type engagement and a conduit pipe extending downward from the cap part.

The above-mentioned bottle cap may further comprise: a spacing band assembled around the externally threaded part at a position between the guide part and the cap part, thus spacing the spraying unit apart from the immobile unit by a predetermined interval.

In another embodiment, the present invention provides a bottle cap comprising an immobile unit having a guide part tightened to the mouth of a bottle body through a screw-type engagement and a chamber part inserted into the mouth of the bottle body with a breaking tip and a through hole provided on and in the bottom the chamber part. The bottle cap also comprises a storage container having a cylinder part inserted into the chamber part; a breakable film covering and closing an open lower end of the cylinder part; an externally threaded part extending from the upper end of the cylinder part and engaging with the guide part of the immobile unit through a screw-type engagement; and a protective film covering and closing an open upper end of the externally threaded part. The bottle cap also comprises a nipple cap tightened to the externally threaded part through a screw-type engagement and a protective cap covering the nipple cap.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
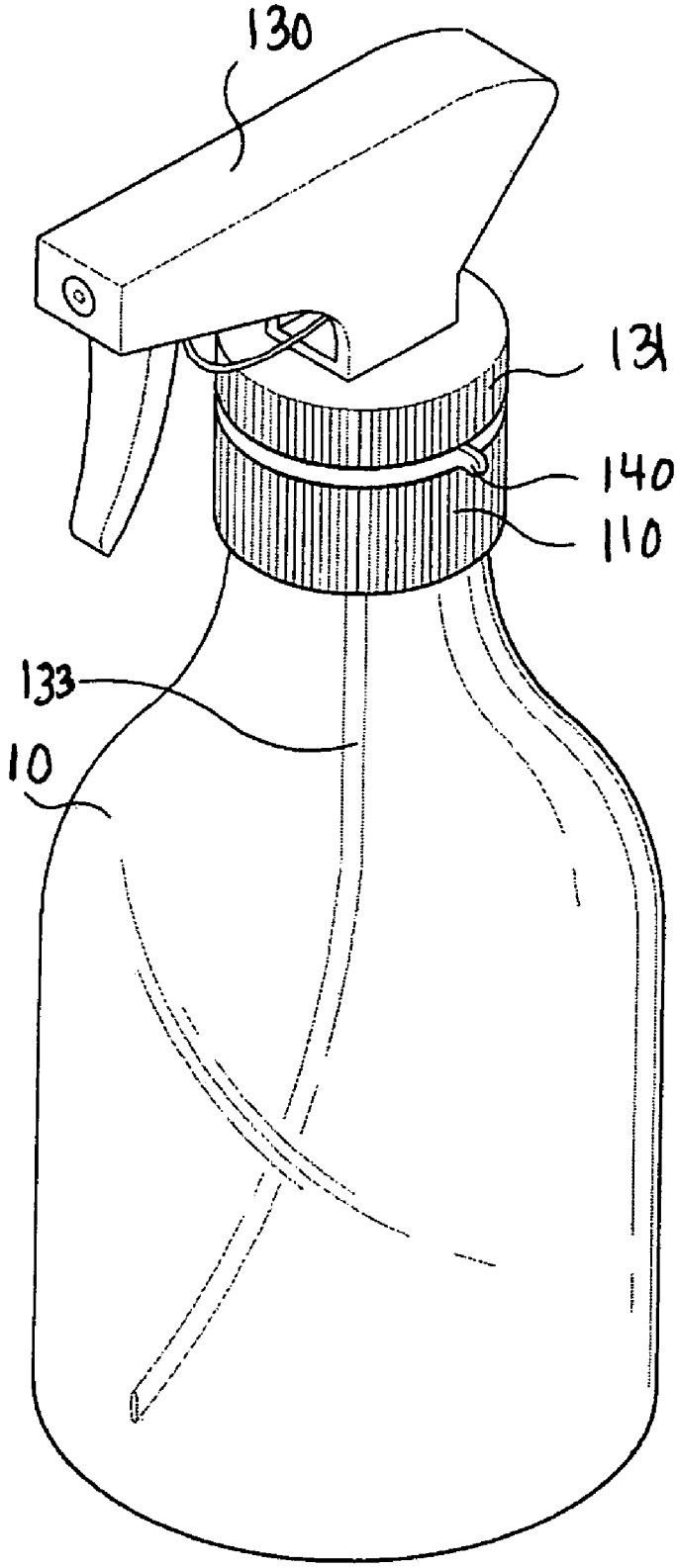
FIG. 1 is a perspective view illustrating a bottle having a cap according to a first embodiment of the present invention.

Reference now should be made to the drawings, in which the same reference numerals are used throughout the different drawings to designate the same or similar components.

Figure 2:
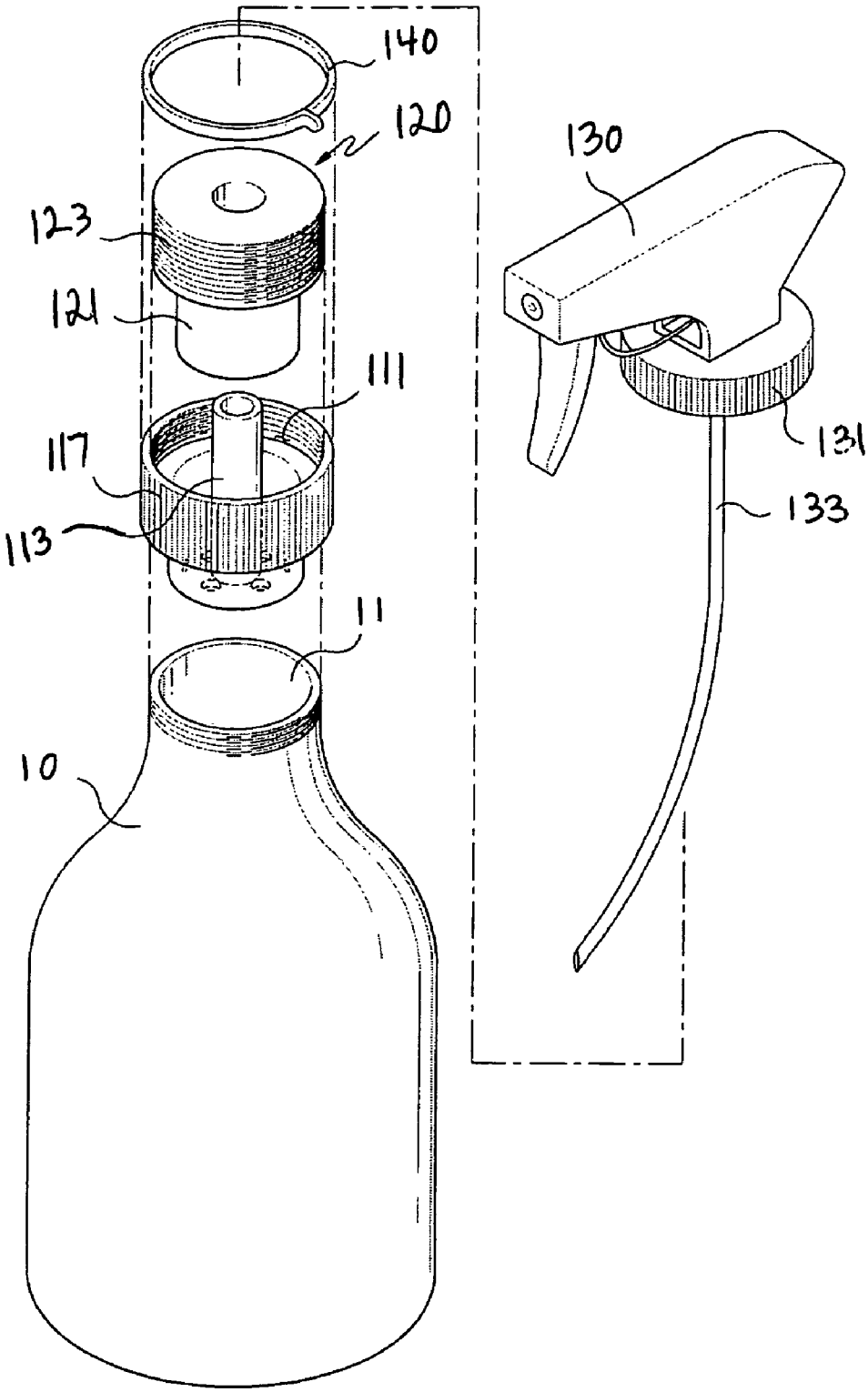
FIG. 2 is an exploded perspective view of FIG. 1.
Figure 3:
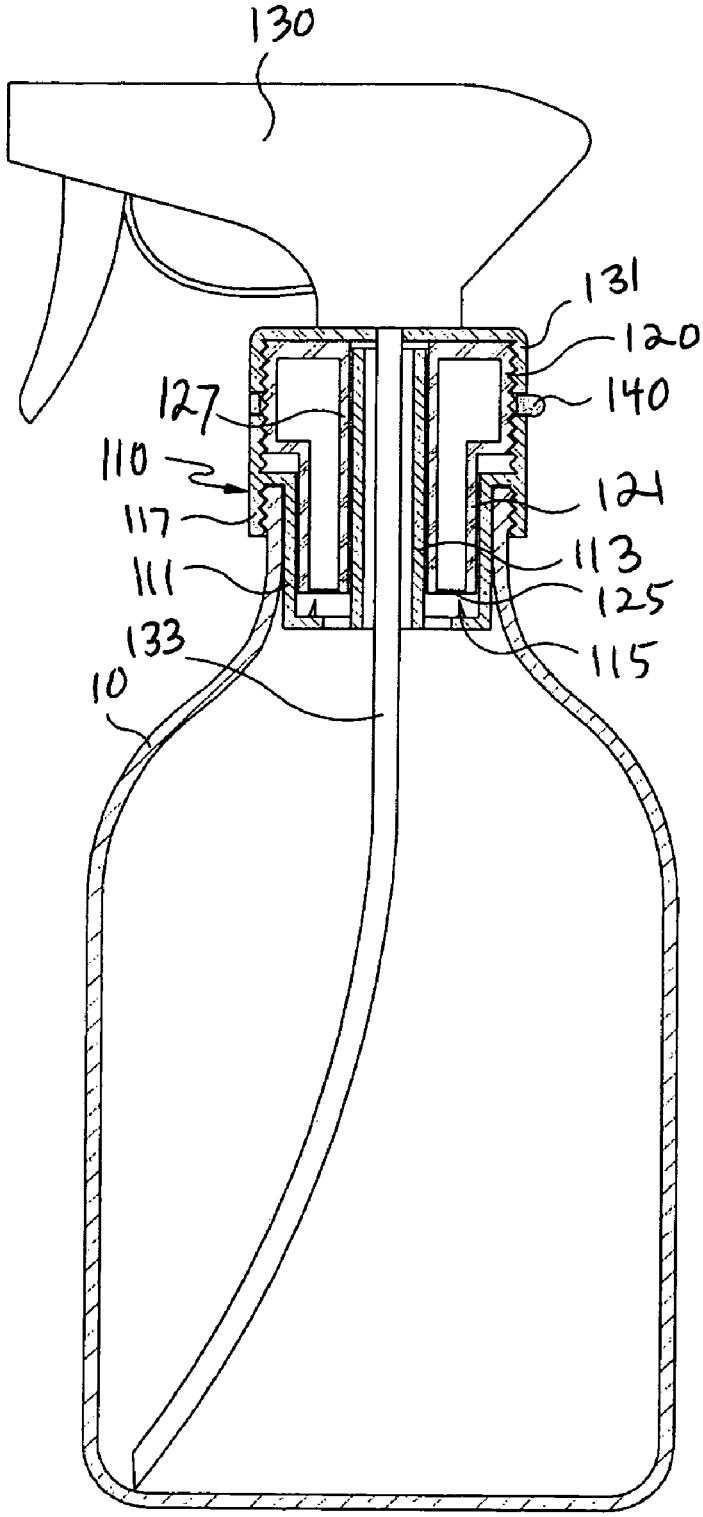
FIG. 3 is a sectional view of FIG. 1.

As shown in FIGS. 1 through 3, a bottle cap according to a first embodiment of the present invention comprises an immobile unit 110 tightened onto an externally threaded mouth 11 of a bottle body 10 through a screw-type engagement, a storage container 120 inserted into the immobile unit 110 and tightened to the unit 110 through a screw-type engagement, a spraying unit 130 tightened to the storage container 120 through a screw-type engagement, and a removable spacing band 140 assembled with the storage container 120 and placed between the immobile unit 110 and the spraying unit 130.

The immobile unit 110 has a chamber part 111 which has an opening defined at an upper end thereof. The chamber part 111 extends into the mouth 11 of the bottle body 10 when the bottle cap is attached to the bottle body 10. The chamber part 111 has a bottom wall with a pipe part 113 extending upward from the center of the bottom wall 111. A plurality of breaking tips 115 protrude upward from the bottom wall of the chamber part 111. A plurality of through holes is formed through the bottom wall of the chamber part 111. A cylindrical guide part 117 having an internal thread is provided around the upper end of the chamber part 111 for tightening the immobile unit 110 onto the mouth 11 of the bottle body 10.

The storage container 120 comprises a cylinder part 121 which is inserted into the chamber part 111 of the immobile unit 110, and an externally threaded part 123 which extends upward from the upper end of the cylinder part 121. The cylinder part 121 defines an opening at a lower end thereof, with a breakable film 125 covering and closing the open lower end of the cylinder part 121. The upper end of the storage container 120 is closed. The storage container 120 is structured so that a hole extends vertically through the storage container to form a cylindrical inner wall 127 through the storage container 120 while the contents stored in the storage container 120 are kept therein so long as the film 125 covers the lower end of the cylinder part 121. The storage container 120 is inserted into the chamber part 111 of the immobile unit 110 so that the externally threaded part 123 engages with the internal thread of the guide part 117. In the above state, the pipe part 113 of the immobile unit 110 is inserted into the hole of the storage container 120. Furthermore, only a portion of the externally threaded part 123 engages with the guide part 117. In other words, because both the spacing band 140 and a cap part 131 of the spraying unit 130, which will be described later herein, as well as the above-mentioned guide part 117 must sequentially engage with the externally threaded part 123, the guide part 117 can engage with only a portion of the externally threaded part 123. The cylinder part 121 contains therein an additive, such as a detergent or a brightening agent.

The spraying unit 130 has a cap part 131 at a lower end thereof, and the cap part 131 is structured to tighten onto the externally threaded part 123 of the storage container 120. The spraying unit 130 has a conduit pipe 133 extending downward from the center of the lower part of the spraying unit 130. The conduit pipe 133 is inserted through the pipe part 133, which is inserted into the hole of the storage container 120, until the conduit pipe 133 reaches the lower portion in the interior of the bottle body 10.

The spacing band 140 is removably assembled around the externally threaded part 123 of the storage container 120 such that the band 140 is placed between the guide part 117, which engages with the lower portion of the externally threaded part 123, and the cap part 131 which engages with the upper portion of the externally threaded part 123. The spacing band 140 spaces the breakable film 125 apart from the breaking tips 115 by a predetermined interval as shown in FIG. 3.

The bottle cap having the above-mentioned construction has the following operational effect. When the cap part 131 is rotated clockwise at a predetermined angle after the spacing band 140 is removed from the cap bottle, the breakable film 125 comes into contact with the breaking tips 115 so that the film 125 is broken in a circumferential direction. Because the tips 115 have a tapered structure and are sharpened at their upper ends, the broken parts of the breakable film 125 are gradually widened by the tapered tips 115. After the breakable film 125 is broken as described above, the bottle body 10 is shaken by a user so that the additive is easily discharged from the cylinder part 121 into the interior of the bottle body 10 and is mixed with a liquid (water in most cases) contained in the bottle body 10. The above-mentioned bottle cap containing an additive therein can be circulated in markets so that a user purchasing the bottle cap tightens the bottle cap onto the mouth of a bottle.

Figure 4:
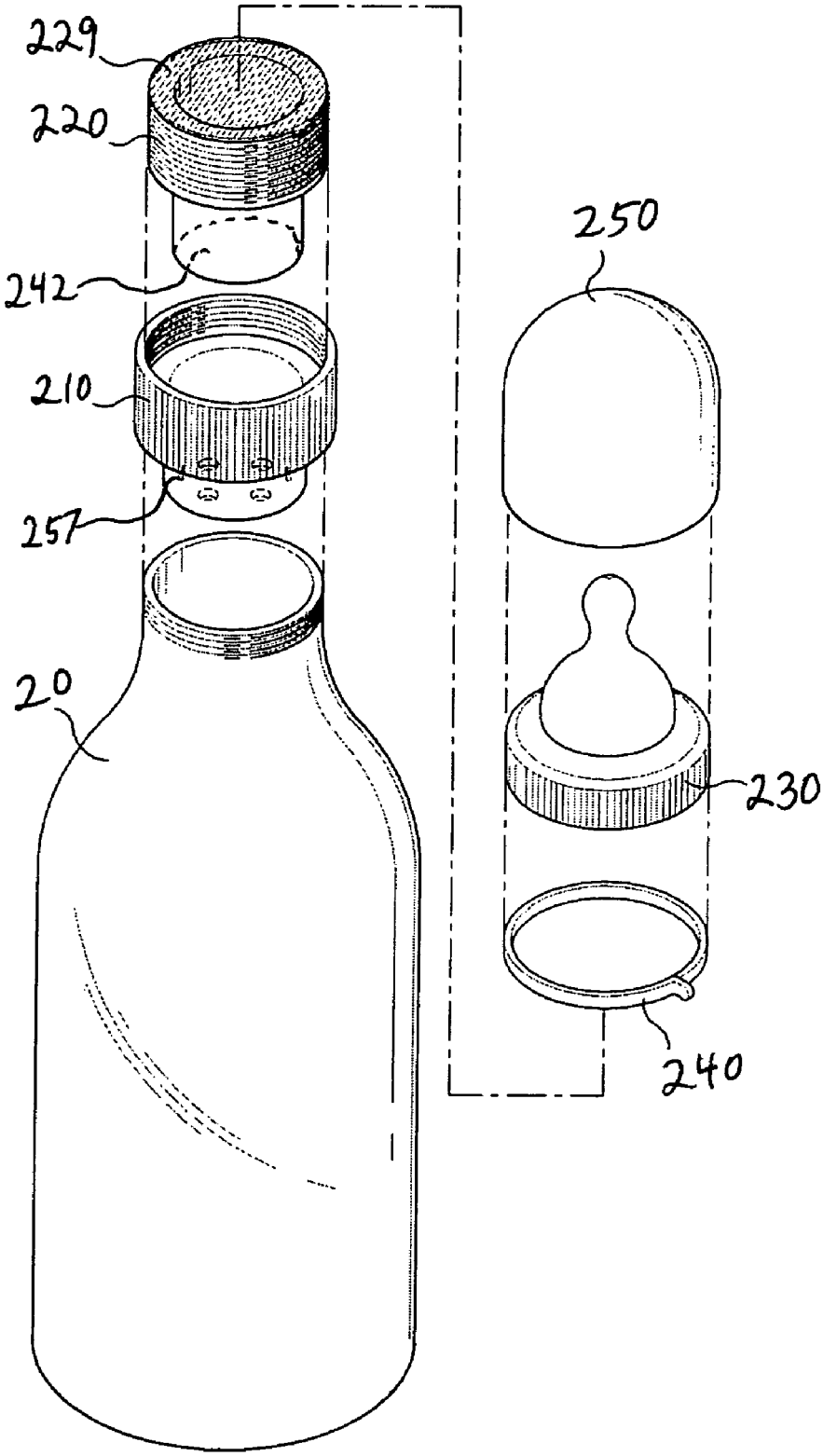
FIG. 4 is an exploded perspective view illustrating a bottle having a cap according to a second embodiment of the present invention.

FIG. 4 illustrates a bottle having a cap according to a second embodiment of the present invention. As shown in the drawing, the bottle cap according to the second embodiment of the present invention comprises an immobile unit 210 tightened to the externally threaded mouth of a bottle body 20 through a screw-type engagement, a storage container 220 inserted into the immobile unit 210 and tightened to the immobile unit 210 through a screw-type engagement, a nipple cap 230 tightened to the storage container 220 through a screw-type engagement, and a spacing band 240 assembled with the storage container 220 and placed between the immobile unit 210 and the nipple cap 230.

In the second embodiment, the general shape of the bottle cap remains the same as that described for the first embodiment so that only the parts different from those of the first embodiment will be described herein below.

Unlike the first embodiment, the cap bottle according to the second embodiment has the nipple cap 230 in place of the spraying unit 130. Thus, in the second embodiment, the pipe part 113 and the hole through the storage container 120 are not provided in the immobile unit 210 or the storage container 220. The upper end of the storage container 220 is opened, with a protective film 229 covering the open upper end of the storage container 220. The nipple cap 230 is covered with a protective cap 250. The nipple cap 230 may be variously shaped as Mickey Mouse, a puppy, a cat, etc.

The bottle cap having the above-mentioned construction according to the second embodiment is operated as follows. First, the nipple cap 230 is released from the storage container 230, and the protective film 229 is removed from the storage container 220. Thereafter, the nipple cap 230 is tightened onto the storage container 220 again. The nipple cap 230 is rotated clockwise at a predetermined angle after the spacing band 240 is removed from the cap bottle. Thus, a breakable film 242, provided at the lower end of the storage container 220, comes into contact with breaking tips 257 provided on the bottom wall of the immobile unit 210 so that the film 242 is broken in a circumferential direction. After the breakable film 242 is broken as described above, the bottle body 20 is shaken by a user so that an additive is easily discharged from the storage container 220 into the interior of the bottle body 20 and is mixed with a liquid (water in most cases) contained in the bottle body 20.

In the second embodiment, the additive contained in the storage container 220 may be powdered milk.

As described above, the present invention provides a bottle cap which has a spraying unit or a nipple cap, with a space defined therein to contain an additive, such as a detergent, brightening agent or powdered milk. Thus, the bottle cap can be distributed in markets separately from bottles, thereby reducing the transportation costs of products, allowing users to save money, and saving natural resources.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bottle cap for use with a bottle having a mouth, said bottle cap comprising:

an immobile unit having a guide part and chamber part, said guide part being formed to tighten said immobile unit onto said mouth of said bottle body; said chamber part having a bottom, at least one breaking tip protruding upward from the bottom of said chamber part, and at least one through hole formed through the bottom of the chamber part;

a storage container having a cylinder part disposed in the chamber part, said cylinder part defining an opening at a lower end thereof, a breakable film covering and closing said opening at said lower end of the cylinder part; a hole defined through said storage container; and an externally threaded part extending from an upper end of the cylinder part and engaged with the guide part of the immobile unit through a screw-type engagement;

a spraying unit having a cap part tightened to the externally threaded part through a screw-type engagement; and a conduit pipe extending downward from the spraying unit.

2. The bottle cap as set forth in claim 1, further comprising:

a spacing band assembled around the externally threaded part at a position between the guide part and the cap part, thus spacing the spraying unit apart from the immobile unit by a predetermined interval.

3. The bottle cap as set forth in claim 1, further comprising:

a pipe part extending upward from the bottom of the chamber part of the immobile unit, and wherein said hole formed through said storage container is formed to receive the pipe part therein.

4. A bottle cap for use with a bottle having a mouth, said bottle cap comprising:

an immobile unit having a guide part tightened to a mouth of a bottle body through a screw-type engagement; and a chamber part inserted into the mouth of the bottle body, with a breaking tip and a through hole disposed in the chamber part;

a storage container having a cylinder part inserted into the chamber part; a breakable film covering and closing an open lower end of the cylinder part; and an externally threaded part extending from an upper end of the cylinder part and engaging with the guide part of the immobile unit; and, a nipple cap tightened to the externally threaded part.

5. The bottle cap as set forth in claim 4, further comprising a protective film covering and closing an open upper end of the externally cylindrical part of the storage container.

6. The bottle cap as set forth in claim 4, further comprising a protective cap covering the nipple cap.

7. The bottle cap as set forth in claim 4, further comprising:

a spacing band assembled around the externally threaded part at a position between the guide part and the nipple cap, thus spacing the nipple cap apart from the immobile unit by a predetermined interval.

* * * * *